United States Patent [19]

Nakada et al.

[11] 4,345,501

[45] Aug. 24, 1982

[54] AUTOMATIC PERFORMANCE TEMPO CONTROL DEVICE

[75] Inventors: Akira Nakada, Hamamatsu; Eisaku Okamoto, Hamakita; Kiyoshi Yoshida, Hamamatsu, all of Japan

[73] Assignee: Nippon Gakki Seizo Kabushiki Kaisha, Hamamatsu, Japan

[21] Appl. No.: 272,644

[22] Filed: Jun. 11, 1981

[30] Foreign Application Priority Data

Jun. 18, 1980 [JP] Japan ..... 55-82507

[51] Int. Cl.[3] ..... G10H 1/40

[52] U.S. Cl. ..... 84/1.03; 84/DIG. 10; 84/DIG. 12

[58] Field of Search ..... 84/1.01, 1.03, 1.17, 84/1.24, DIG. 10, DIG. 12, DIG. 22

[56] References Cited

U.S. PATENT DOCUMENTS 4,062,263 12/1977 Yamaga et al. ..... 84/1.03

4,242,936 1/1981 Swain ..... 84/1.03

*Primary Examiner*—S. J. Witkowski

*Attorney, Agent, or Firm*—Spensley, Horn, Jubas & Lubitz

[57] ABSTRACT

A tempo control device for automatic performance according to this invention is of a type wherein a tempo of automatic performance is caused to automatically follow that of manual performance as the latter changes during performance. When difference in tempo between manual and automatic performance falls within a predetermined range, this automatic follow-up control is performed by measuring the manual performance tempo with accuracy and by controlling the frequency of tempo clock pulses in the automatic performance on the basis of the value thus measured. The predetermined range may be one fixed range for all notes of various note-lengths, or alternatively, different ranges may be employed in accordance with the length of notes.

8 Claims, 8 Drawing Figures

TCL
121
121a
INITIAL TEMPO OSC.
OSC. CIRCUIT
121b
FOLLOW TEMPO OSC.
SD
SE
SA
SB
SC
122
ΔPL
123
120
SELECTOR
A
B
C
D
E
SA SB SC SD SE
F1
F2
F3
F4
F5
G1
G2
G3
G4
G5
I1
I2
I3
I4
I5
118A(16TH)
118B(8TH)
118C (QUARTER)
118D (HALF)
118E (WHOLE)
LAT
CTR
CK
R
L
ΔPL
OG
Φ/2
Φ/4
Φ/8
Φ/16
119A
119B
119C
119D
1/2
Φ
KON'
115A
115B
115C
115D
115E
117
CT
DIF.
KON
21"
FF
S
Q
114A (16TH)
114B (8TH)
114C (QUARTER)
114D (HALF)
114E (WHOLE)
COMP1
COMP2
A1
A2
B1
B2
C1
C2
D1
D2
E1
E2
110
CN
COUNTER
PSD
PE
111
112
113
Co
CT

AUTOMATIC PERFORMANCE TEMPO CONTROL DEVICE

BACKGROUND AND SUMMARY OF THE INVENTION

This invention relates to an automatic performance tempo control device and, more particularly, to a tempo control device which controls an automatic performance tempo to follow a manual performance tempo.

The term "automatic performance" as herein used is intended to mean not only the automatic performance of melody or chord according to stored data but also the automatic bass/chord, arpeggio or rhythm performance, and further intended to mean automatic displaying of the key to be depressed.

In a variety of conventional automatic performance devices, the automatic performance tempo can be set as desired by operating the tempo control knob of the tempo signal generator. However, since the automatic performance is, in general, carried out in accompaniment with the manual performance, it is considerably difficult for the manual performer to delicately operate the tempo control knob during the performance. Thus, in practice, it is impossible to change a preset tempo in automatic performance during performance to express a performer's feeling to the music.

Accordingly, an object of the invention is to provide a novel automatic performance tempo control device in which no special tempo control operation is required.

In the tempo control device according to the invention, when the manual performance tempo is in a predetermined error range with respect to the automatic performance tempo, the automatic performance tempo is caused to follow the manual performance tempo.

The nature, principle and utility of the invention will become more apparent from the following detailed description when read in conjunction with the accompanying drawings.

DETAILED DESCRIPTION OF THE INVENTION

Figure 1:
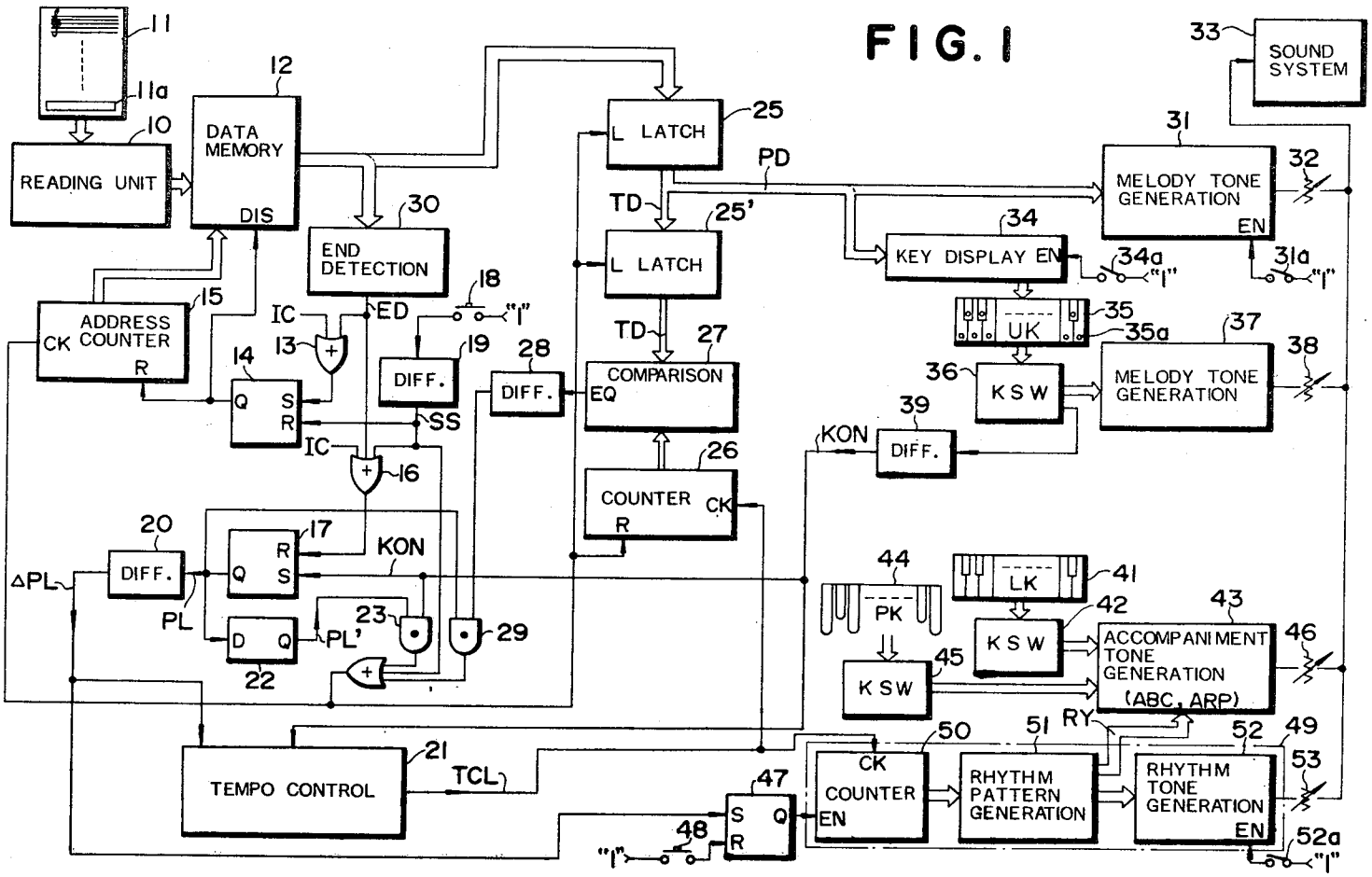
FIG. 1 is a block diagram showing a keyboard type electronic musical instrument according to one embodiment of the invention.

FIG. 1 shows a keyboard type electronic instrument according to one embodiment of this invention. In this electronic musical instrument, melodies are performed by automatic performance and/or manual performance, and accompaniments are performed by manual performance, or if necessary, in the form of automatic bass/-chord or automatic arpeggio. In addition, the electronic musical instrument can perform automatic rhythms. Furthermore, the electronic musical instrument is so constructed that the tempo in automatic melody tone performance, automatic bass/chord, automatic arpeggio or automatic rhythm tone performance automatically follow the tempos of manual performance for melody tones.

Figure 2:
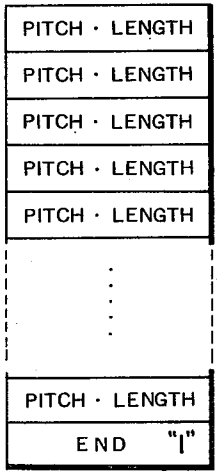
FIG. 2 shows a data format employed in the electronic musical instrument in FIG. 1.

A reading unit 10 operates to read score data out of a recording medium 11*a* such as a magnetic tape provided in the lower margin of a score 11 and to cause a data memory 12 to store the data thus read. As shown in FIG. 2, in the score data, the pitch and length of each note are expressed by a binary code, and an end data (in which all bits are set to "1") is provided next to the last note. Each pitch data is expressed as a key code including a 4-bit note code and a 3-bit octave code. In the length data (data for note length), a thirty-second note, a sixteenth note, an eighth note, a quarter note, a half note and a whole note are expressed by binary codes corresponding to numbers 8, 16, 32, 64, 128 and 256, respectively. A rest is expressed by setting all of the bits of the key code to "0".

The data memory 12 having stored the musical note data and the end data as described above is, in the initial state, placed in a disable state (DIS) according to the output Q of an R-S flip-flop 14 which is set by an initial clear signal IC provided via an OR gate 13. In this state, the output Q of the flip-flop 14 is further applied to an address counter 15 to reset the counter 15, and therefore no address signal is applied to the memory 12 by the address counter. Furthermore, the initial clear signal IC is applied through an OR gate 16 to an R-S flip-flop 17 to reset the flip-flop 17, and therefore the output Q of the flip-flop 17 is at a logical level "0" (hereinafter referred to merely as "0", when applicable).

When a start switch 18 is turned on, its "on" signal is subjected to rise-differentiation in a differentiation circuit 19 so that it is converted into a start signal SS. The start signal SS resets the flip-flop 14 and is applied, as a reset input R, to a flip-flop 17 through the OR circuit 16. As a result, the output Q of the flip-flop 14 is set to "0". Therefore, the counter 15 becomes ready for counting a clock input CK, while the memory 12 becomes ready for reading data, and the output Q of the flip-flop 17 is maintained at "0". The start signal SS is further applied through an OR gate 24 to the counter 15, so that a pitch data and a length data corresponding to the first note are read out of the memory 12 and are then latched by a latch circuit 25.

Upon start of a manual performance with the upper keyboard described later, a first key-on signal KON is produced. Then, the flip-flop 17 is set by the key-on signal KON and delivers a performance signal PL as its output Q. The performance signal PL is raised to "1" at the start of manual performance, and it is maintained at "1" until the automatic performance is ended and subjected to rise-differentiation in a differentiation circuit 20, so that it is converted into a performance start signal ΔPL in synchronism with the performance start timing. The performance start signal ΔPL is applied to a tempo control circuit 21 (which will be described with reference to FIG. 3). On the other hand, the performance signal PL, after being slightly delayed by a D flip-flop 22, is supplied, as a delay signal PL', to one input terminal of an AND gate 23. Since the key-on signal KON is being applied to the other input terminal, the AND gate 23 outputs the key-on signal KON when the signal PL' is "1". In this operation, the output signal of the AND gate 23 is supplied, as the clock input CK, to the counter 15 through an OR gate 24, and it is further supplied, as a latch instruction signal L, to the latch circuit 25 and another latch circuit 25'. At the same time, the output signal of the AND gate 23 is applied, as a reset signal R, to a counter 26. Accordingly, the counter 15 supplies an address signal to specify the second data read address to the memory 12, and a pitch data and a length data corresponding to the second note are read out of the memory 12. These data are latched by the latch circuit 25. The length data TD corresponding to the first note which has been latched in the latch circuit 25 is latched by the latch circuit 25'. The counter 26, after being reset by the reset signal R, starts counting a tempo clock signal TCL from the tempo control circuit 21.

The length data TD from the latch circuit 25' is compared with the count output of the counter 26 in a comparison circuit 27. When the data TD coincides with the count output of the counter 26, the comparison circuit 27 outputs a coincidence signal EQ. After being subjected to rise-differentiation in a differentiation circuit 28, the coincidence signal EQ is applied to one input terminal of an AND gate 29. As the performance signal PL is applied to the other input terminal of the AND gate 29 by the flip-flop 17, the AND gate 29 delivers the output coincidence signal of the differentiation circuit 28 to the OR gate 24. Accordingly, when the count value of the tempo clock signal TCL reaches the time corresponding to the length of the first note, the OR gate 24 produces an output signal. This output signal is applied to the counter 15, the latch circuits 25 and 25' and the counter 26. As a result, the counter 15 operates so that a pitch data and a length data corresponding to the third note are read out of the memory 12, while a tone length measuring section including the latch circuit 25', the counter 26 and the comparison circuit 27 carries out the tone length measurement of the second note in the same manner as in the preceding case. In the same manner, reading the data from the memory and measuring the tone length are carried out until the memory 12 outputs the end data.

When the end data is outputted, it is detected by an end data detecting circuit 30, as a result of which an end signal ED is outputted by the detecting circuit 30. The end signal ED is applied through the OR gate 13 to the flip-flop 14 to set the flip-flop 14. Therefore, the memory 12 is placed in the disable state, and the counter 15 is placed in the reset state. The end signal ED is further applied through the OR gate 16 to the flip-flop 17 to reset the flip-flop 17. As a result, the performance signal PL is set back to "0". Thus, a series of data reading operations have been accomplished.

As the musical note data are sequentially read out as described above, the pitch data PD of each score data is supplied from the latch circuit 25 to a monitoring melody tone generating circuit 31. When a select switch 31*a* is turned on, the circuit 31 is placed in enable (EN) state so that a musical tone signal is electronically synthesized according to an input pitch data. The musical tone signal is supplied through a variable resistor 32 to a sound system 33 where it is converted into a sound.

The pitch data PD is further applied to a key display circuit 34. When a select switch 34*a* is turned on, the key display circuit 34 is placed in enable state, so that light emitting elements 35*a* provided respectively on each key of the upper keyboard (UK) 35 are selectively turned on to indicate the positions of keys to be depressed. The pitch data which is one note before a key to be depressed is supplied to the monitoring melody tone generating circuit 31 and the key display circuit 34.

The upper keyboard 35 is coupled to a key switch (KSW) circuit 36. The key switch circuit 36 operates to supply a keying signal indicating a depressed key to a manual performance melody tone generating circuit 37, in which a musical tone signal is electronically synthesized according to an input keying signal. This musical tone signal is applied through a variable resistor 38 to the sound system 33, where it is converted into a sound.

Besides the above-described keying signal, an any-key-on signal is produced by the key switch circuit 36 whenever a key is depressed. The any-key-on signal is applied to a differentiation circuit 39, in which it is subjected to rise-differentiation. As a result, the any-key-on signal is converted into the key-on signal KON synchronous with the key-on timing. The key-on signal KON is applied to the above-described flip-flop 17, and to the tempo control circuit 21 for tempo control.

The case where melody tones are automatically produced according to the stored data has been described. Other tones such as chord tones can also be automatically produced according to the same operational principle.

A lower keyboard (LK) 41 is provided with a key switch circuit 42 which operates to supply a keying signal representative of a depressed key to an accompaniment tone generating circuit 43, to which a keying signal from a key switch circuit 45 coupled to a pedal keyboard 44 is also supplied. The accompaniment tone generating circuit 43 operates to synthesize a musical tone signal electronically in accordance with the keying signals from the key switch circuits 42 and 45. The accompaniment tone generating circuit 43 is so constructed that it can form a musical tone signal in the form of automatic bass/chord (ABC) or automatic arpeggio, if necessary. Furthermore, the accompaniment tone generating circuit 43 can provide a musical tone signal which is sectional with rhythm in response to a rhythm signal RY from an automatic rhythm. section (described later). The musical tone signal from the accompaniment generating circuit 43 is supplied through a variable resistor 46 to the sound system 33, where it is converted into a sound.

A R-S flip-flop 47 is set by the above-described performance start signal ΔPL and reset by the "on" signal from a stop switch 48. Its output Q controls an automatic rhythm unit 49. The automatic rhythm unit 49 comprises: a counter 50 for counting the output tempo clock signal TCL of the tempo control circuit 21; a rhythm pattern generating circuit 51 for generating a rhythm pattern signal according to the count output of the counter 50; and a rhythm tone generator circuit 52 which is driven by the rhythm pattern signal from the circuit 51. The output Q of the flip-flop 47 is applied, as an enable signal EN, to the counter 50. The counter 50 starts its counting operation in synchronism with the performance start timing, and stops its counting operation in synchronism with the "on" timing of the stop switch 48. The rhythm pattern generating circuit 51 produces the rhythm signal RY to be supplied to the accompaniment tone generating circuit 43 in addition to the generation of the rhythm pattern signal. When a select switch 52*a* is turned on, the rhythm tone generator 52 is placed in enable state and sends out a rhythm tone signal according to the rhythm pattern signal from the rhythm pattern generating circuit 51. The rhythm tone signal is applied through a variable resistor 53 to the sound system 33, where it is converted into a sound. Therefore, in the case where the select switch 52*a* has been turned on, an automatic rhythm tone is produced in synchronism with the manual performance start timing in the upper keyboard, and the production of the automatic rhythm tone is stopped when the stop switch 48 is depressed.

The arrangement and operation of the tempo control circuit 21 will be described with reference to FIGS. 3 and 4. The tempo control circuit 21 is constructed as follows: The circuit 21 counts the tempo clock signal TCL. Whenever the count value of the tempo clock signal TCL comes close to the time corresponding to the length of a quarter note (corresponding to a reference TCL count value "64"), the tempo control circuit 21 determines with the aid of the tempo clock signal TCL and the key-on signal KON whether or not the manual performance tempo is in a predetermined error range (corresponding to the range of TCL count values "58" to "72") with respect to the automatic performance tempo. Whenever the determination result is acceptable, the circuit 21 changes the frequency of the tempo clock signal TCL to cause the automatic performance tempo to follow the manual performance tempo.

In the initial state, the initial clear signal IC is applied through an OR gate 60 to an R-S flip-flop 61 to reset the flip-flop 61, so that the output FFQ of the flip-flop 61 is at "0". When a manual performance is started in order to generate a melody tone corresponding to the first quarter note in a musical note as shown in FIG. 4, the performance start signal ΔPL obtained by differentiating the performance signal PL is applied through an OR gate 62 to a counter 63 to reset the counter 63. At the same time, the performance start signal ΔPL from the OR gate 62 is supplied through an OR gate 64 to a modulo-64 counter 65 to reset the counter 65. The performance start signal ΔPL is further applied through an OR gate 66 to a counter 67 and through an OR gate 68 to a counter 69, to reset these counters 67 and 69. The performance start signal ΔPL resets latch circuits 70, 71 and 72 and a counter 73. When the counter 73 is reset, its output becomes "0", which in turn raises a selection signal SA which is the output of an inverter 74 to "1". Therefore, a selector 75 selects the oscillation output of a tempo clock oscillator 76 which corresponds to an output A of the selector as the tempo clock signal TCL. The oscillator 76 operates to receive the performance start signal ΔPL from the OR gate 62 as a synchronizing signal SY to carry out its oscillation. The output frequency of the oscillator 76 can be suitably changed by means of a variable resistor 76*a*. A variable frequency divider 77 is employed to frequency-divide a clock signal $\phi$ having a frequency much higher than that of the tempo clock signal TCL. The circuit 77 operates to receive the performance start signal ΔPL from the OR gate 62 as a synchronizing signal SY to carry out its frequency division operation.

The counters 63 and 65 count the tempo clock signal TCL and the counters 67 and 69 count the clock signal $\phi$ after being reset as described above.

The performance start signal ΔPL from the OR gate 62 is applied through a D flip-flop 78 and the OR gate 60 to the reset input R of the flip-flop 61.

When the count value of the counter 63 reaches "57" from "0", a lower limit detecting circuit 79 detects the count value "57" (corresponding to the TCL count number "58" which is the lower limit in the error range) to output an output signal MIN. This output signal MIN sets the flip-flop 61, so that its output FFQ is raised to "1". This output signal FFQ raised to "1" is applied to an AND gate 80 to open the gate 80.

When the count value of the counter 65 reaches "64", the counter 65 provides a carry out output, which is applied through an OR gate 64 to the same counter 65 to reset the counter 65. At the same time, the counter 69 also outputs a carry out output, to reset itself 69. As is apparent from the above description, both of the counters 65 and 69 are reset simultaneously whenever the time corresponding to the length of a quarter note passes, i.e. whenever sixty-four tempo clock signals TCL are counted. The counter 65, after being reset, counts the tempo clock signal TCL; and the counter 69 also, after being reset, counts the clock signal $\phi$.

Figure 4:
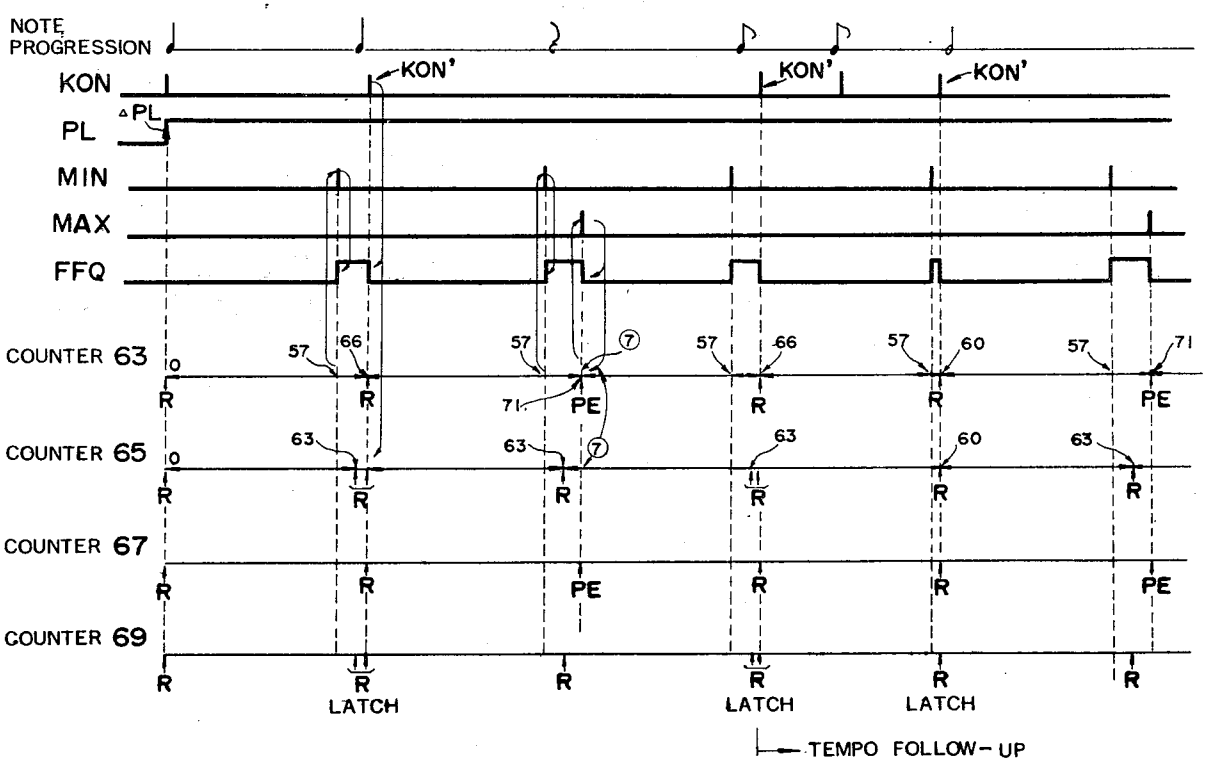
FIG. 4 is a time chart for the operation of the circuit in FIG. 3.

It is assumed that a key-on signal KON corresponding to the second note in the musical note shown in FIG. 4 is provided somewhat after the timing the count value of the counter 63 counts the tempo clock signal TCL in synchronism with the counter 65 reaches "64"; i.e. with the timing the count value of the counter 63 reaches "67". In this case, as the AND gate 80 is open as described before, it provides an output signal KON′ in correspondence to the key-on signal KON. The output signal KON′ is applied, as a latch instruction signal L, to the latch circuits 70, 71 and 72. Therefore, the count output of the counter 67 is latched by the latch circuit 70. At the same time, the output signal KON′ is applied to one input terminal of the AND gate 81, to the other input terminal of which the output of the counter 73 is applied through an inverter 82. When the signal KON′ is provided, the output of the counter 73 is at "0", and therefore the output of the inverter 82 is at "1". Thus, the AND gate 81 is open. Accordingly, the output signal KON′ is supplied through the AND gate 81 to the counter 73. The counter 73 produces a carry out output "1" whenever it counts two output signals KON′. Therefore, in the case when the counter 73 has counted one output signal KON′, its output is at "0". The output signal KON′ is applied through the OR gate 62 to the counter 63 to reset the counter 63 and it is further applied through the OR gates 62 and 64 to the counter 65 to reset the counter 65. Thereafter, the counters 63 and 65 thus count up the tempo clock signal TCL.

The output signal KON′ is slightly delayed by a D flip-flop 83. The delay signal is applied through OR gates 66 and 68 to the counters 67 and 69 to reset the counters 67 and 69. At the same time, the output signal KON′ is applied through the flip-flop 78 and the OR gate 60 to the flip-flop 61 to reset the flip-flop 61. Thereafter, the counters 67 and 69 thus count up the clock signal $\phi$.

When the count value of the counter 63 reaches "57", similarly as in the above-described case, the lower limit detecting circuit 79 produces the output signal MIN, so that the flip-flop 61 is set to raise the output FFQ thereof to "1" and in turn opens the AND gate 80. Thus, similarly as in the above-described case, the counters 65 and 69 are reset at the timing when the content of the counter 63 reaches the count value "64". Thereafter, the counters 65 and 69 thus count up the tempo clock signal TCL and the clock signal $\phi$. On the other hand, the counter 63 is not reset, because, unlike the above-described case, no key-on signal KON is produced when the music note is a rest. However, when the count value of the counter 63 reaches "71", an upper limit detecting circuit 84 detects the count value "71" (corresponding to the TCL count number "72" which is the upper limit in the error range) to produce an output signal MAX. By the output signal MAX, the counter 63 is placed in preset enable (PE) state, and a preset data PSD corresponding to the counter value "7" is preset in the counter 63 from the counter 65. At the same time, the counter 67 is also placed in preset enable (PE) state by the output signal MAX, and therefore a preset data is preset in the counter 67 from the counter 69. As a result, the counters 63 and 67 carry out the subsequent counting operations as if they had carried out the counting operations by regarding the timing when the count value of the counter 63 reaches "64" as zero (0). The above-described data preset operation is carried out not only in the case when no key-on signal KON is produced because of a rest but also in the case where, although the key-on signal has been produced in response to a note, the key-on timing is not within the above-described error range.

When the count value of the counter 63 reaches "57", similarly as in the above-described case the output FFQ of the flip-flop 61 is raised to "1" and the AND gate 80 is opened. Thereafter, at the timing when the count value of the counter 63 reaches the "64", the counters 65 and 69 are reset similarly as in the above-described case. If it is assumed that a key-on signal KON corresponding to an eighth note next to the quarter rest is produced by the manual performance, at a timing slightly later than the above, i.e. at the timing when the count value of the counter 63 reaches "67", then an output signal KON′ is outputted by the AND gate 80. In response to this output signal KON′, the count data latched during manual performance (key-on) of the quarter note before the quarter rest is transferred from the latch circuit 70 to the latch circuit 71, while the count output of the counter 67 is latched in the latch circuit 70 in response to the output signal KON′ synchronous with the key-on of the eighth note next to the quarter rest. The count data latched by the latch circuits 70 and 71 are supplied, as inputs A and B, respectively to an averaging circuit 85, in which they are averaged into $(A+B)/2$. That is, the averaging circuit 85 operates to average the count data at adjacent key-on timings to suppress the frequent variations of the count data. In the above-described example, each of the count data before and after the quarter rest shows a value corresponding to the TCL count number "67" (corresponding to the count value "66" of the counter 63) which is slightly later than the reference count value "64", and therefore the data which is obtained by averaging the two count data shows a value similar to those before the averaging operation. The count data averaged by the averaging circuit 85 is latched by the latch circuit 72 in response to the output signal KON′, and is then applied to a frequency divider 77 as a frequency division ratio specifying signal. The frequency divider 77 is so designed that, when the frequency division ratio specifying signal corresponds to the reference count number "64", it sends out a frequency division output the frequency of which is equal to the oscillation frequency of an oscillator 76. When the frequency division ratio specifying signal corresponding to the TCL count number "67" is supplied, the frequency of the frequency division output lowers in corresondence to the difference between the TCL count numbers $(67-64=3)$.

On the other hand, the output signal KON′ is applied through the AND gate 81 to the counter 73. Thus, the counter 73, counting two input signals, produces the carry out output "1". The carry out output "1" is applied through an inverter 82 to the AND gate 81 to close the gate 81, and causes the selector 75 to select the frequency division output (input B) of the frequency divider 77. As a result, instead of the output of the oscillator 76, the output of the frequency divider 77 is delivered, as a tempo clock signal TCL, out of the selector 75 in synchronism with the key-on timing of the eighth note next to the quarter rest. The frequency of the tempo clock signal TCL at this moment is lowered corresponding to the delay of the manual performance tempo against the automatic performance tempo. As said tempo clock signal TCL is applied to the relevant sections in FIG. 1, the tempos in various automatic performances of melody, bass/chord, arpeggio and rhythm section tones becomes slow to follow the manual performance tempo. As in the above case of keying the quarter note before the quarter rest, when the output signal KON′ is produced in synchronism with the key-on timing of the eighth note after the quarter rest, the counters 63 and 65 become reset, and slightly later than this reset timing the flip-flop 61 and the counters 67 and 69 become reset.

Then, the second eighth note after the first eighth note is keyed on. In this case, as the count number of tempo clock signal TCL is around "32" and does not reach a value close to the reference count number "64", the above-described tempo clock frequency control operation is not carried out.

When the count value of the counter 63 reaches "57", as in the above-described case, the output FFQ of the flip-flop 61 is raised to "1", and the AND gate 80 opens. Thereafter, when a half note after the second eighth note is keyed on at the timing when the count value of the counter 63 reaches "61" (slightly before the timing when the count value of the counter 63 reaches "64"), the AND gate 80 produces the output signal KON′ in synchronism with the key-on timing. This output signal KON′ resets the counters 63 and 65, and slightly later than this reset timing, resets the counters 67 and 69 and the flip-flop 61. In addition, at the time of production of the signal KON′, the preceding count data is transferred from the latch circuit 70 to the latch circuit 71, while the count output provided immediately before the count 67 is reset is latched by the latch circuit 70.

Therefore, the count data corresponding to the TCL count number "61" (which is "60" for the count value of the counter 63) is supplied from the latch circuit 70 to the averaging circuit 85, and the count data corresponding to the TCL count number "67" (which is "66" for the count value of the counter 63) is supplied from the latch circuit 71 to the averaging circuit 85. In the averaging circuit 85, these count data are averaged so that a count data corresponding to the TCL count number "64" (which is "63" for the count value of the counter 63) is delivered out. This averaged count data is latched by the latch circuit 72 at the time of production of the signal KON′ so as to be supplied, as the frequency division ratio specifying signal, to the frequency divider 77. In the frequency divider 77, the clock signal $\phi$ is subjected to frequency division according to the frequency division ratio specifying signal corrsponding to the count number "64", and the frequency of the frequency division output is heightened by the TCL count number difference (3=67−64) compared with that corresponding to the preceding TCL count number "64". This frequency division output is applied through the selector 75, as the tempo clock signal TCL, to the relevant sections shown in FIG. 1 so that the tempos of automatic performance of various types of tones become quicker to follow the manual performance tempo.

When the count value of the counter 63 reaches "57", the same operation is carried out as in the above-described case of the quarter rest. Thereafter, the tempo clock frequency control operation is carried out at every reference count number "64" under the condition that the signal KON′ is produced nearby the reference count number. As a result, the automatic performance tempo is changed automatically to follow the manual performance tempo.

Figure 5:
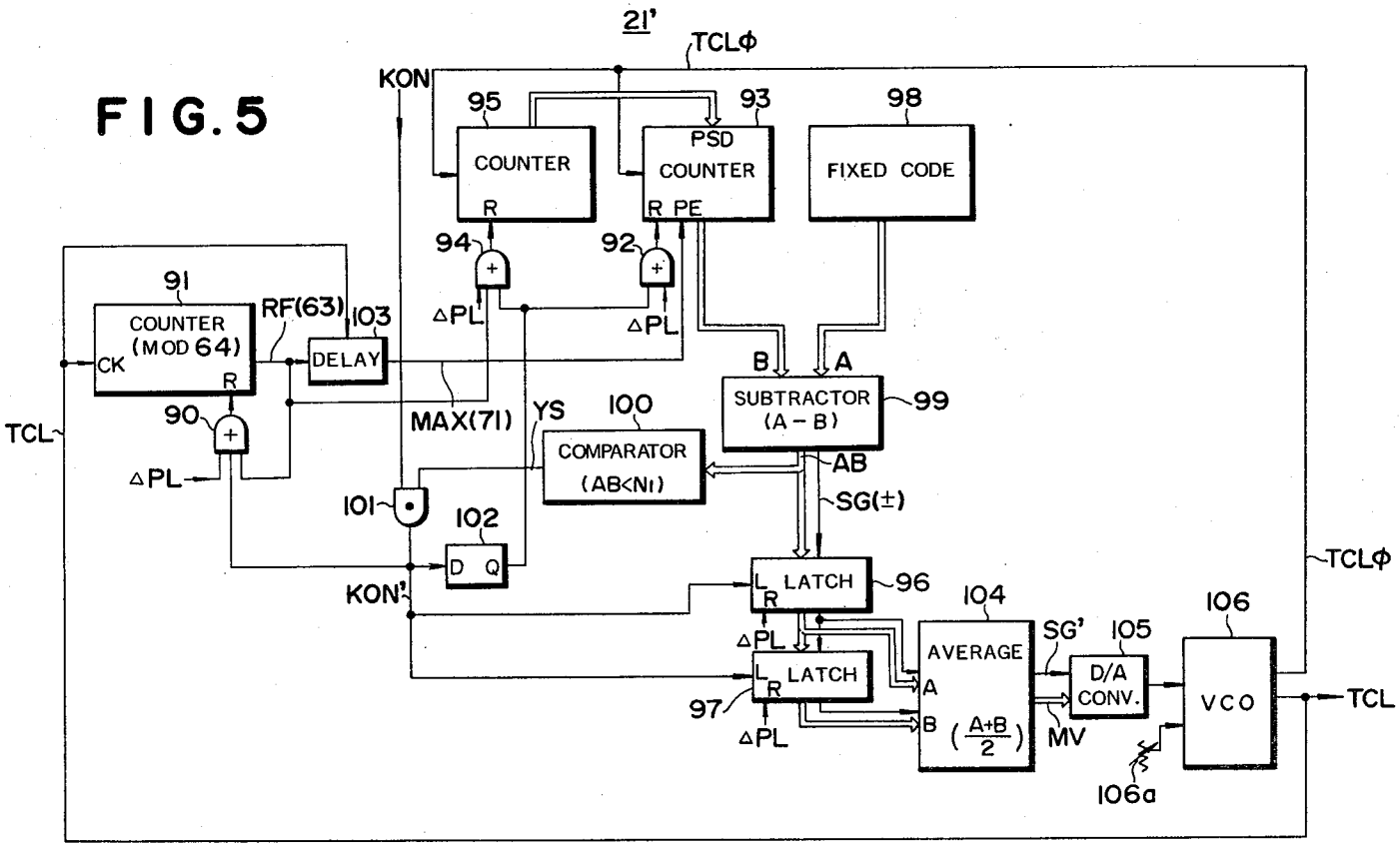
FIG. 5 is a block diagram for another example of the tempo control circuit.

FIG. 5 shows a tempo control circuit 21′ according to another embodiment of the invention, in which a tempo control circuit 21′ is so constructed that its tempo clock frequency control is performed in a manner similar to that in the above-described circuit 21 with a different circuit configuration.

When a performance start signal ΔPL is produced in response to the first quarter note in a musical note progression as shown in FIG. 4, the signal ΔPL is applied through an OR gate 90 to a tempo clock signal TCL counting counter 91 to reset the counter 91. At the same time, the signal ΔPL is applied through OR gates 92 and 94 to counters 93 and 95 for counting clock signal TCLϕ whose frequency is n times as high as that of the signal TCL, to reset these counters 93 and 95, respectively, and it is further applied to latch circuits 96 and 97 to reset these circuits 96 and 97. Above noted n represents a positive integer number.

When the TCL count number in the counter 91 reaches "64" (which is "63" for the count number of the counter 91), the counter 91 produces a reference count signal RF. This reference count signal RF is applied through the OR gates 90 and 94 respectively to the counters 91 and 95 to reset these counters 91 and 95. Thus, whenever the TCL count number "64" is reached, the counters 91 and 95 are reset instantaneously so that, thereafter, they count up the tempo clock signal TCL and the clock signal TCLϕ, respectively. That is, the counters 91 and 95 correspond to the counters 65 and 69 in FIG. 3, respectively.

In the meantime, when the TCL count number reaches "58" (which is "57" for the count value of the counter 91), the counter 93 supplies a count output corresponding to the TCL count number "58", as an input B, to a subtraction circuit 99 which receives as an input A a code output corresponding to a reference count number N (=64·n) from a fixed code generator 98. As a result, the subtraction circuit 99 produces an output signal AB representative of the absolute value of the difference (A−B) between the inputs A and B (which corresponds to TCL count value "6·n"), and an output signal SG representative of the sign (+) of the value. This output signal AB is supplied to a comparison circuit 100, in which judgement is made on whether or not the absolute value of the difference is smaller than $N_1$ which corresponds to TCL count value "7·n" ($AB<N_1$). In this case, the absolute value is the value corresponding to TCL count value "6·n", thus satisfying the condition $AB<N_1$, and therefore the comparison circuit 100 produces an output signal YS to open an AND gate 101. When, under the condition that the AND gate 101 is open, the second quarter note in FIG. 4 is keyed on, then a key-on signal KON is supplied to the AND gate 101, as a result of which the gate 101 produces an output signal KON′.

The output signal KON′ is supplied through the OR gate 90 to the counter 91 to reset the counter 91, and is further supplied as a latch instruction signal L to the latch circuits 96 and 97. In this operation, the count output of the counter 93 corresponds to the TCL count number "67" (which is "66" for the count value of the counter 91), and the subtraction circuit 99 produces an output signal AB representative of the absolute value corresponding to TCL count value "3·n" and an output signal SG representative of the sign (−). These output signals AB and SG are latched by the latch circuit 96 with the aid of the output signal KON′. The output signal KON′ is converted into a signal by a D flip-flop 102 which is slightly delayed from the key-on timing. This delayed signal is applied through the OR gates 92 and 94 respectively to the counters 93 and 95 to reset these counters 93 and 95. The counters 93 and 95, after being reset, count up the clock signal TCLϕ.

When the TCL count number of the counter 91 reaches "58", the AND gate 101 is opened by the output signal YS of the comparison circuit 100, and when the TCL count number of the counter 91 reaches "64", the counter 91 outputs the reference count signal RF, which resets the counters 91 and 95 similarly as in the above-described case. Thereafter, if no keying operation is carried out in correspondence to the quarter rest in the musical note progression in FIG. 4 for a period of time corresponding to seven tempo clock signals TCL, no output signal KON′ is produced by the AND gate 101. On the other hand, since the output signal KON′ is delayed by a period of time corresponding to seven tempo clock signals TCL by the delay circuit 103, the delay circuit 103 produces an upper limit detection signal MAX at the timing when the TCL count number reaches "72" (which is "71" for the count value of the counter 91). The upper limit detection signal MAX is supplied, as a preset enable signal PE, to the counter 93, and a preset data PSD corresponding to the TCL count value "7" is preset in the counter 93. As a result, the counter 93 carries out the subsequent counting operation as if, similarly as in the counter 95, it started the counting operation after being reset at the time instant corresponding to the TCL count number "64". This operation is similar to that described with reference to the counters 67 and 69 in FIG. 3. When the preset data is preset in the counter 93, then the condition $AB<N_1$ is not satisfied any longer in the comparison circuit 100, and therefore the comparison output signal YS is set to "0".

Next, when the TCL count number of the counter 91 reaches "58", similarly as in the above-described case the AND gate 101 is opened by the output signal YS of the comparison circuit 100, and when the TCL count number of the counter 91 reaches "64", similarly as in the above-described case the counters 91 and 95 are reset by the reference count signal RF. If slightly later than this, or at the timing when the count value of the counter 91 reaches "67", the eighth note next to the quarter rest shown in FIG. 4 is keyed on, then the AND gate 101 produces an output signal KON′ in synchronism with the key-on timing.

The output signal KON′ resets the counter 91 and causes the latch circuits 96 and 97 to carry out the latch operations. As a result, the previous data (representative of the absolute value of the difference which corresponds to TCL count value "3·n" and the sign (−)) latched in the latch circuit 96 is transferred to the latch circuit 97, and simultaneously a new subtraction data is latched by the latch circuit 96. The new subtraction data is the same as the previous subtraction data, because the present key-on timing is substantially the same as the timing of the count value of "67" of the counter 91 similarly as in the case of keying the quarter note before the quarter rest. Accordingly, the same subtraction data are applied, as inputs A and B, to the averaging circuit 104 from the latch circuits 96 and 97, and these data are averaged in the form of (A+B)/2. As a result, the averaging circuit 104 produces an output signal MV corresponding to TCL count value "3·n" and an output signal SG′ indicating the sign (−) of the difference. These output signals are applied to D/A (digital-to-analog) conversion circuit 105, where they are converted into the corresponding analog signal. The analog signal is supplied to a tempo oscillation circuit 106 including a voltage-controlled variable frequency oscillator (VCO).

Initially, the tempo oscillation circuit 106 operates to produce a tempo clock signal TCL having a frequency corresponding to the reference tempo (reference count number "64") according to an initial set voltage from a variable resistor 106*a*. In the case where the analog signal is supplied to the tempo oscillation circuit 106 from the D/A conversion circuit 105, the analog signal is added to the voltage signal from the variable resistor 106*a*, so as to be applied, as a control input, to the VCO, whereby the frequency of the tempo clock signal TCL is changed. For instance when the average output corresponding to TCL count value "−3·n" is produced as described above, then the control voltage of the VCO is decreased by a value corresponding to "3·n", and in response to the decrease the frequency of the tempo clock signal TCL is lowered. In addition, it should be noted that the tempo oscillation circuit 106 is so constructed as to produce the clock signal TCL$\phi$ also.

In the above description, the count values of the counters 93 and 95 and subtraction value of A−B have been described as values corresponding to TCL count values. This is made to simplify the description. In actual operation, however, these counters 93 and 95 count clock pulses which are a predetermined number of times faster than tempo clock pulses. Accordingly, the count values of these counters 93 and 95 are said predetermined number of times as large as that of the counter 91 and this also applies to the subtraction data. As a result, the subtraction value will change even during the period when the counter value of the counter 91 remains unchanged. Therefore, when a key is depressed at any timing, regardless that the count value of the counter 91 is changing or not, the subtraction value is calculated according to the key depression timing, whereby enabling the frequency of the tempo clock corresponding to the key depression timing to be finely controlled.

As a result of the above-described operation, the automatic performance tempo faster than the manual performance tempo becomes slower to follow the manual performance tempo. In contrast, when the automatic performance tempo is slower than the manual performance tempo, an averaged output representing a value (+p) corresponding to the difference between the two tempos is outputted. Therefore, the frequency of the tempo clock signal TCL is increased in response to a signal which is obtained by performing D/A conversion to the averaged output, as a result of which the automatic performance tempo becomes faster to follow the manual performance tempo.

Figure 3:
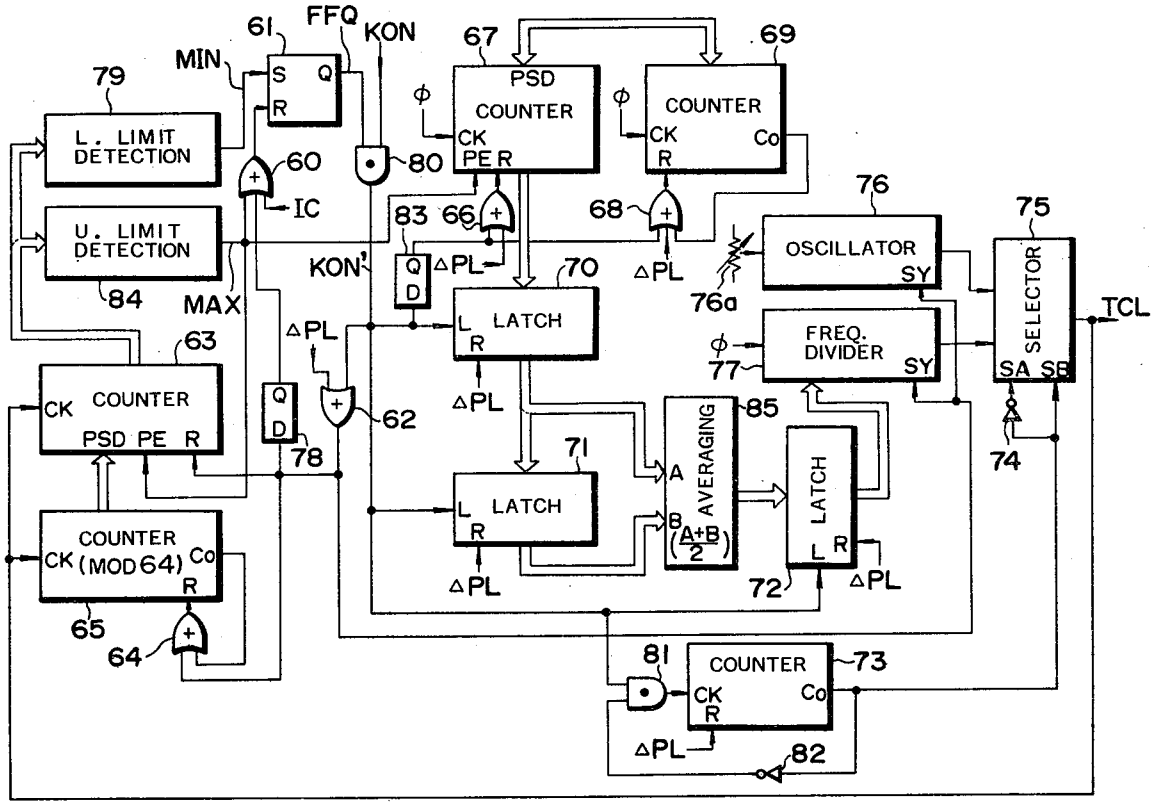
FIG. 3 is a block diagram for one example of a tempo control circuit in the electronic musical instrument in FIG. 1.

Similarly as in the circuit 21 in FIG. 3, the above-described tempo clock frequency control operation is carried out at every reference count number "64" under the condition that the signal KON′ is produced in a neighborhood of the reference count number "64".

Figure 6:
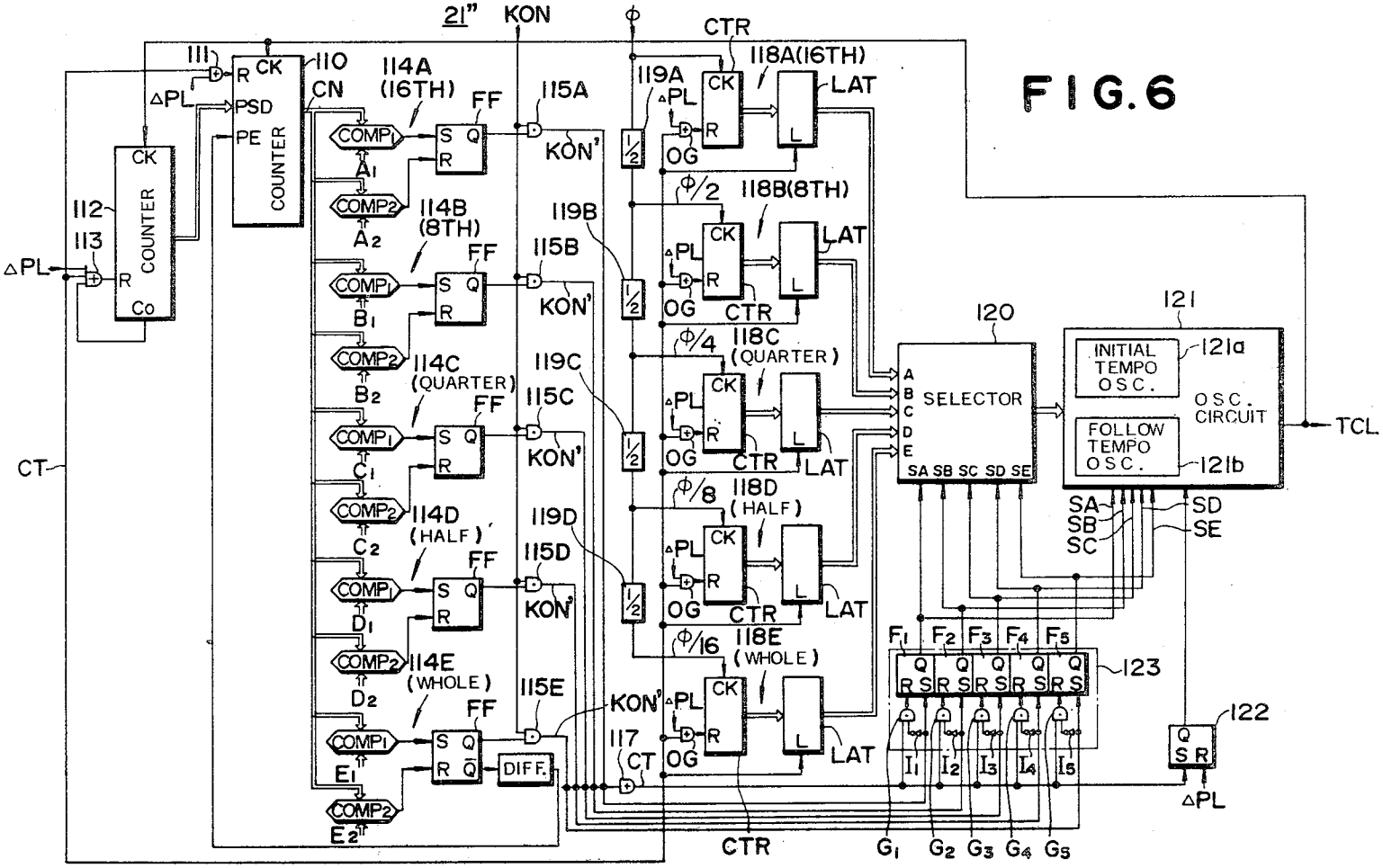
FIG. 6 is a block diagram for another example of the tempo control circuit.

A tempo control circuit 21″ according to another embodiment of the invention will be described with reference to FIG. 6. The specific feature of the tempo control circuit 21″ resides in that tempo clock signals TCL are successively counted with respect to plural kinds of notes, and whenever the count number reaches a time corresponding to each note length, a judgement is made on whether or not tempo control is required using an error range varied with notes.

A counter 110, after being reset by the performance start signal ΔPL from an OR gate 111, counts the tempo clock signal TCL. A counter 112, after being reset by the performance start signal ΔPL from an OR gate 113, counts the tempo clock signal TCL. A tempo control instruction signal CT is applied, as a reset signal R, respectively to these counters 110 and 112 through the OR gates 111 and 113. The counters 110 and 112, after being reset synchronously with the tempo control instruction signal CT whenever it is produced, start the counting of the tempo clock signal TCL again. When the TCL count number "256" corresponding to the duration of one bar (or a whole note) is reached, the counter 112 produces a carry out output Co. This carry out output Co is applied through the OR gate 113 to the counter 112 to reset the counter 112. A preset data PSD is applied to the counter 110 from the counter 112. In response to a preset enable signal PE, the preset data PSD is preset in the counter 110.

Figure 7:
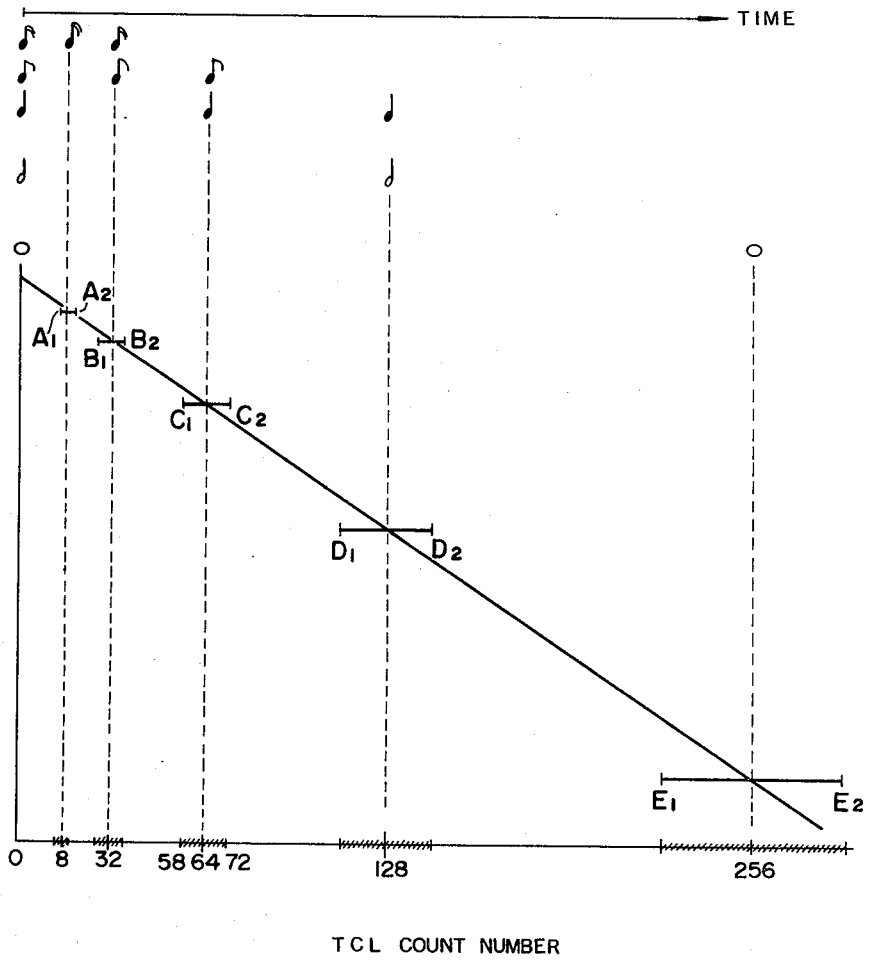
FIG. 7 shows the comparison operation of the circuit in FIG. 6.

The count output CN of the counter 110 is applied to comparison circuits 114A, 114B, 114C, 114D and 114E which are provided for a sixteenth note, an eighth note, a quarter note, a half note and a whole note, respectively. These comparison circuits 114A through 114E have the same circuit configuration in which an R-S flip-flop is set and reset respectively by the outputs of comparators COMP1 and COMP2. As shown in FIG. 7, the comparison operations of the comparison circuits are carried out in such a manner that they are different in comparison range individually according to the kinds of notes. That is, in the comparison circuit 114A, the flip-flop is set when the count output CN reaches $A_1$ and is reset when CN reaches $A_2$ by applying suitable values $A_1$ and $A_2$ corresponding to count numbers which are respectively smaller and larger than a reference count value number "8" corresponding to a sixteenth note to the comparators COMP1 and COMP2 as comparison reference inputs. In the comparison circuit 114B, by applying values $B_1$ and $B_2$ corresponding to count numbers which are smaller and larger than a reference count value number "32" corresponding to an eighth note to the comparator COMP1 and COMP2 as comparison reference inputs, the flip-flop FF is set when the count output CN reaches $B_1$, and the flip-flop FF is reset when the output CN reaches $B_2$. The range $B_1$ to $B_2$ is set wider than the $A_1$ to $A_2$. Therefore, the duration of the output Q of the flip-flop FF in the comparison circuit 114B is longer than that of the output Q of the flip-flop FF in the comparison circuit 114A. Similarly, in the remaining comparison circuits 114C, 114D and 114E, as the TCL count number is increased the comparison ranges $C_1$ to $C_2$, $D_1$ to $D_2$ and $E_1$ to $E_2$ are made wider in corresponding to the count numbers close to a reference count number corresponding to a quarter note, a reference count number corresponding to a half note and reference count number corresponding to a whole note, respectively, and the durations of the outputs Q of the respective flip-flops are made longer as the TCL count number is increased. The reason why the comparison ranges in the comparison circuits 114A through 114E are made wider as the TCL count number increases is to prevent the chances of key-on timing detection from being greatly decreased as the TCL count number increases.

The flip-flop outputs Q in the comparison circuits 114A through 114E are applied to first input terminals of AND gates 115A through 115E, respectively, to the other input terminals of which a key-on signal KON synchronous with key-on timing is applied. Therefore, if, when any one of the flip-flop outputs $\overline{Q}$ in the comparison circuits 114A through 114E is at "1" and a note corresponding to that flip-flop output is keyed on, the corresponding AND gate (one of the AND gates 115A through 115E) produces an output signal KON'.

In the comparison circuit 114E for a whole note, the output $\overline{Q}$ of the flip-flop FF is subjected to rise-differentiation by a differentiation circuit 116, so that it is converted into a preset enable signal PE for the counter 110. The flip-flop output $\overline{Q}$ of the comparison circuit 114E is raised to "1" when the count output CN reaches the upper limit value $E_2$ in the comparison range corresponding to a whole note. The preset enable signal PE is raised to "1" in synchronism with the timing when the output $\overline{Q}$ is raised to "1", as a result of which the preset data PSD from the counter 112 is preset in the counter 110. This preset data PSD corresponds to the TCL count number of the counter 112 for the time interval that the counter 112 is reset at the timing of the TCL count number "256" until the count output Cn coincides with $E_2$. When this preset data PSD is preset in the counter 110 as described above, the counter 110 carries out the following counting operation as if, similarly as in the counter 112, it started the counting operation after being reset. In this connection, the production of the preset enable signal PE means that none of the AND gates 115A through 115E produce the output signal KON' for a period of time from "0" to "$E_2$" (in other words, no key-on signal KON is produced, or although a key-on signal KON is produced, the time of production of the key-on signal falls in none of the comparison ranges $A_1$ to $A_2$ through $E_1$ to $E_2$).

An OR gate 117 receives the output signal KON' from each of the AND gates 115A through 115E to output the tempo control instruction signal CT. The signal CT is applied to the above-described OR gates 111 and 113, and to control data forming circuits 118A, 118B, 118C, 119D and 118E which are provided respectively for a sixteenth note, an eighth note, a quarter note, a half note and a whole note. These control date forming circuits 118A through 118E have the same circuit configuration comprising an OR gate OG receiving the performance start signal ΔPL and the tempo control instruction signal CT, a counter CTR which is reset by the output of the OR gate OG, and a latch circuit LAT which latches the count output of the counter CTR according to the tempo control instruction signal CT. Clock signals different in frequency are applied to the counters CTR in the control data forming circuits 118A through 118E, respectively. More specifically, the counter CTR in the circuit 118A counts the clock signal $\phi$ (having a frequency much higher than the signal TCL), the counter CTR in the circuit 118B counts a clock signal $\phi/2$ which is obtained by subjecting the clock signal $\phi$ to $\frac{1}{2}$ frequency division in a frequency division circuit 119A, the counter CTR in the circuit 118C counts a clock signal $\phi/4$ which is obtained by subjecting the clock signal $\phi/2$ to $\frac{1}{2}$ frequency division in a frequency division circuit 119B, the counter CTR in the circuit 118D counts a clock signal $\phi/8$ which is obtained by subjecting the clock signal $\phi/4$ to $\frac{1}{2}$ frequency division in a frequency division circuit 119C, and the counter CTR in the circuit 118E counts a clock signal $\phi/16$ which is obtained by subjecting the clock signal $\phi/8$ to $\frac{1}{2}$ frequency division in a frequency division circuit 119D. The frequencies of the count inputs are made lower successively with the durations of the respective notes as described above, in order to reduce the number of bits in the counter CT and the latch circuit LAT in each control data forming circuit (118) and to simplify circuits coupled thereto.

In the control data forming circuits 118A through 118E, the counters CTR, after being reset by the performance start signal ΔPL, count the respective inputs $\phi$ through $\phi/16$. When the tempo control instruction signal CT is raised to "1", the latch circuits LAT latch the count outputs of the respective counters CTR, and immediately after this the counters CTR are reset by the signal CT. Thus, the latch circuits LAT deliver out as control data signals the count outputs of the counters CTR immediately before the latter are reset.

The control data signals from the control data forming circuits 118A through 118E are applied as inputs A through E to a selector 120, respectively. When one of the selection signals SA through SE is raised to "1", the selector 120 selects the corresponding input (any one of the inputs A through E) and supplies it to an oscillation circuit 121. The oscillation circuit 121 comprises an initial tempo oscillator (OSC) 121*a* and a follow tempo oscillator 121*b*. The oscillation circuit 121 is so designed that, according to the output Q of an R-S flip-flop 122, the oscillation output of the oscillator 121*a* or 121*b* is outputted, as the tempo clock signal TCL. The flip-flop 122, after being reset by the performance start signal ΔPL, is set by the tempo control instruction signal CT. When the output Q of the flip-flop 122 is at "0", the oscillation output of the oscillator 121*a* is outputted as the tempo clock signal TCL; and when the output Q is at "1", the oscillation output of the oscillator 121*b* is outputted as the tempo clock signal TCL.

The oscillation frequency of the follow tempo oscillator 121*b* is controlled by a control data corresponding to a particular note which is provided by the selector 120 and by the corresponding selection signal (one of the signals SA through SE). In the case where the control data signal is produced when the count numbers of the counters in the control data forming circuits 118A through 118E come to correspond to reference TCL count numbers "8", "32", "64", "128"and "256", respectively, the oscillator 121*b* oscillates at the same frequency as the initial tempo oscillator 121*a*. In the case where the control data signal is produced when the count numbers of the counters in the control data forming circuits 118A through 118E come to correspond to TCL count numbers which are larger (or smaller) than the above-described reference TCL count numbers, respectively, the oscillation frequency of the oscillator 121*b* is decreased (or increased) in corresponding to an increment (or decrement) of the TCL count number when compared with the oscillation frequency of the initial tempo oscillator 121*a*.

A selection signal forming circuit 123 comprises: R-S flip-flop $F_1$ through $F_5$ which are set by the output signals KON″ from the AND gates 115A through 115E, respectively; inverters $I_1$ through $I_5$ for inverting the output signals KON′ from the AND gates 115A through 115E, respectively; and AND gates $G_1$ through $G_5$. The outputs of the inverters $I_1$ through $I_5$ are applied to first input terminals of the AND gates $G_1$ through $G_5$, respectively, to the other input terminals of which the tempo control instruction signal CT is applied. The flip-flops $F_1$ through $F_5$ are reset by the outputs of these AND gates $G_1$ through $G_5$, respectively. Therefore, one of the AND gates 115A through 115E outputs the output signal KON′, the corresponding flip-flop (one of the flip-flops $F_1$ through $F_5$) is set, while the remaining flip-flops are reset. The output Q of the flip-flop thus set is applied, as the selection signal (one of the signals SA through SE) corresponding to the AND gate which has provided the signal KON′, to the selector 120 and the oscillation circuit 121. Accordingly, the selector 120 selects the control data signal input (one of the signals A through E) which corresponds to one of the selection signals SA through SE and supplies it to the oscillation circuit 121. In the oscillation circuit 121, The oscillation frequency of the follow tempo oscillator 121*b* is determined by the control data signal from the selector 120 and the selection signal which is supplied by the selection signal forming circuit 123 in response to the control data signal.

The operation of the above-described circuit 21″ will now be described with reference to the musical note in FIG. 4.

Firstly, upon keying on the first quarter note, the performance start signal ΔPL is produced to reset the flip-flop 122. Therefore, the oscillation output of the initial tempo oscillator 121*a* is delivered from the oscillation circuit 121 as the tempo clock signal TCL. At the same time, the performance start signal ΔPL resets the counters 110 and 112 and the counters CTR in the control data forming circuits 118A through 118E. The counters 110 and 112, after being thus reset, count the tempo clock signal TCL, while the counters CTR in the control data forming circuits 118A through 118E, after being thus reset, count the clock signals $\phi$, $\phi/2$, $\phi/4$, $\phi/8$ and $\phi/16$, respectively.

When, the count value of the counter 110 reaches $C_1$ nearby the reference TCL count number 64, the output of the flip-flop FF in the comparison circuit 114C is raised to "1", and the AND gate 115C is opened. If the second quarter note is keyed on slightly later than the time instant when the count value of the counter 110 reaches a value corresponding to the TCL count number "64", the "key-on" signal KON is produced. If the key-on signal KON is within the comparison range $C_1$ to $C_2$ corresponding to a quarter note, the AND gate 115C produces the output signal KON′, in response to which the OR gate 117 produces the tempo control instruction signal CT. This tempo control instruction signal CT resets the counters 110 and 112, causes the latch circuits LAT to latch the count outputs of the respective counters CTR, and resets the counters CTR. At the same time, the tempo control instruction signal CT together with the output signal KON′ are supplied to the selection signal forming circuit 123, so that the circuit 123 outputs the selection signal SC. The signal CT is also supplied to the flip-flop 122 to set the flip-flop 122. Therefore, the selector 120 supplies the control data signal (latch output) from the control data forming circuit 118C to the oscillation circuit 121. In the oscillation circuit 121, the follow tempo oscillator 121*b* is controlled according to the control data signal and the selection signal. As the flip-flop 122 is set as described above, in the oscillation circuit 121 the oscillation output of the follow tempo oscillator 121*b* is delivered out as the tempo clock signal TCL, and therefore the frequency of the tempo clock signal TCL is determined by the selection signal SC and the corresponding control data signal. That is, the control data signal is produced in this case in such a manner that it corresponds to a $\phi$ count number larger than that corresponding to the reference TCL count number "64" (the manual performance tempo is lower than the automatic performance tempo), and therefore the oscillation frequency of the oscillator 121*b* is made lower than that of the oscillator 121*a*. Accordingly, the automatic performance tempo becomes lower following the manual performance tempo.

Next, the TCL count number of the counter 110 reaches a value close to "64" again. However, at this time instant, no keying is carried out because of the quarter rest. Therefore, no output signal KON′ is produced by the AND gate 115C, and the above-described tempo clock frequency changing operation is not carried out. Thereafter, when the count value of the counter 110 reaches $D_1$ in the neighborhood of the TCL count number "128", the output Q of the flip-flop FF in the comparison circuit 114D is raised to "1", and the AND gate 115Dis opened. If the eighth note next to the quarter rest is keyed on slightly before the count value of the counter 110 reaches a value corresponding to the TCL count number "128" and the key-on signal is within the comparison range $D_1$ to $D_2$, the AND gate 115D produces the output signal KON′. Similarly as in the above-described case, the output signal KON′ thus produced resets the counters 110 and 112, causes the control data forming circuit 118D to produce the control data signal and causes the selection signal forming circuit 123 to produce the selection signal SD. Therefore, the follow tempo oscillator 121B is controlled by the selection signal SD and the corresponding control data signal, and its oscillation frequency is made slightly higher than the previous one. Thus, in this case, the automatic performance tempo is made quicker to follow the manual performance tempo.

Similarly as in the above described case, judgement is made on whether the key-on timing falls within the predetermined error range or not for each note, and whenever the result of the judgement is acceptable, the tempo clock frequency control operation is carried out so as to cause the automatic performance tempo to follow the manual performance tempo. In the case where no output signal KON′ is produced until the count value of the counter 110 reaches $E_2$, a tempo control operation similar to that described above is carried out after the preset data from the counter 112 is preset in the counter 110.

Figure 8:
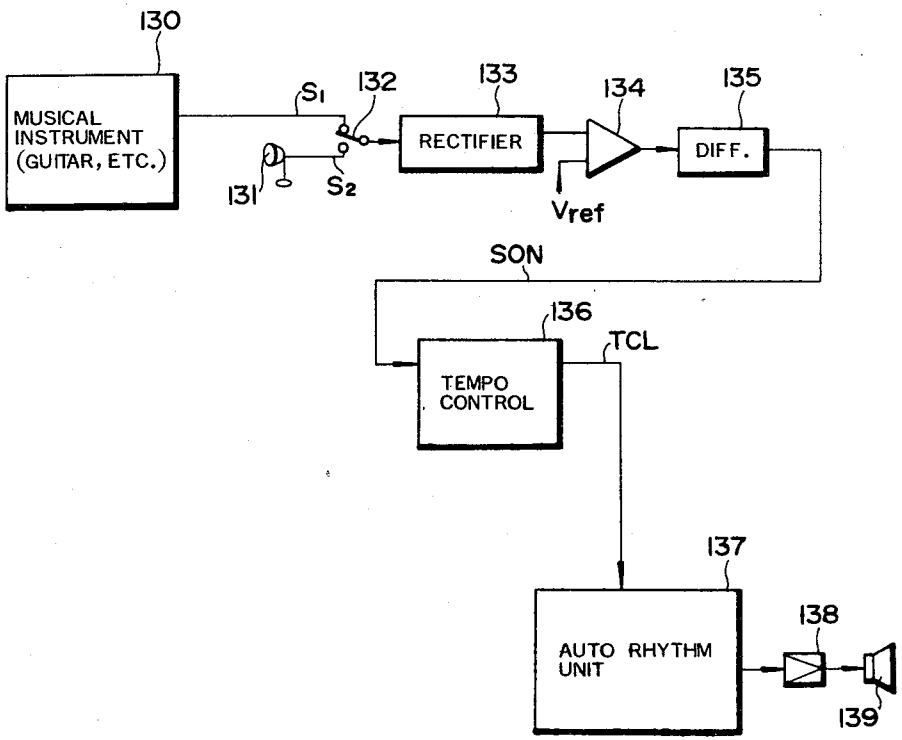
FIG. 8 is a block diagram showing another embodiment of the invention in which the technical concept of the invention is applied to a musical instrument using no keyboard.

FIG. 8 shows another embodiment of the invention in which the technical concept of the invention is applied to a non-keyboard type musical instrument. From a non-keyboard type musical instrument 130 such as a guiter, a first musical tone signal $S_1$ can be detected with an electromagnetic pickup or the like and a second musical tone signal $S_2$ can be detected with a microphone 131 or the like. The musical tone signals $S_1$ and $S_2$ are selectively supplied to a rectifier circuit 133 via a selection switch 132. The rectifier circuit 133 rectifies the input musical tone signal to provide an output, which is applied to one input terminal of a comparator 134. A reference voltage Vref is applied to the other input terminal of the comparator 134, so that it is compared with the output of the rectifier circuit. When the output of the rectifier circuit exceeds the reference voltage Vref, the comparator 134 produces a comparison output. The comparison output is subjected to rise-differentiation in a differentiation circuit 135, so that it is converted into a pulse signal SON synchronous with the performance timing. This pulse signal SON corresponds to the above-described key-on signal KON, and it is supplied to a tempo control circuit 136. The arrangement of the tempo control circuit 136 may be any one of those shown in FIGS. 3, 5 and 6. The tempo control circuit 136 produces a tempo clock signal so that the frequency is varied according to a manual performance tempo represented by the pulse signal SON. The tempo clock signal TCL is applied to an automatic rhythm unit 137 (similar in arrangement to the unit 49 in FIG. 1), which outputs a rhythm section tone signal. The rhythm section tone signal is supplied through an output amplifier 138 to a loudspeaker 139, by which it is converted into a sound.

According to the embodiment shown in FIG. 8, the automatic rhythm tempo can be automatically controlled so as to follow the manual performance tempo of a non-keyboard type musical instrument such as a quitar.

As is apparent from the above description, according to the invention, in the manual performance of a musical instrument with automatic melody, chord and rhythm performances, the automatic performance tempo can be automatically controlled so as to follow the delicate tempo variations in the manual performance. Thus, the automatic performance tempo control device of the invention is not only helpful for the beginner's performance training, but also greatly appreciated for the intermediate or advanced performers because, with this device a variety of musical expressions will become possible in their performance.

What is claimed is:

1. An automatic performance tempo control device comprising:

manual performance signal generating means for generating a manual performance signal comprising a plurality of manual timing pulses in accordance with manual performance;

tempo clock signal generating means for generating a tempo clock signal;

tempo control means which receives said manual timing signal and said tempo clock signal, including judgment means for judging whether or not a pluse out of said manual timing pulses has been generated in a predetermined range around the timing determined by said tempo clock signal; and tempo control signal generating means for generating a tempo control signal in accordance with the result of the judgement of said judgement means, said tempo clock signal generating means further receiving said tempo control signal and modifying the frequency of said tempo clock signal in accordance with said tempo control signal.

2. An automatic performance tempo control device according to claim 1, wherein said predetermined range differs in accordance with note-length.

3. An automatic performance tempo control device according to claim 1, wherein said manual timing pulses correspond to manual operations of said manual performance respectively and said tempo control signal generating means comprises time-measuring means for measuring a time interval of said manual timing pulses, said control signal being related to said time interval.

4. An automatic performance tempo control device according to claim 1, wherein said judgment means receives said manual timing pulse and said tempo clock pulse and produces a judgment signal when said pulse out of said manual timing pulses has generated in said predetermined range, and said control signal generating means comprises time-measuring means for producing a time-measuring signal indicating a time interval of said manual timing pulses and send out means connected to said measuring means for receiving said time measuring signal in response to said judgment signal.

5. An automatic performance tempo control device according to claim 4, wherein said judgment means comprises:

counter means for counting said tempo clock pulses; and circuit means for causing said manual timing signal to pass therethrough in accordance with a count value of said counter means.

6. An automatic performance tempo control device according to claim 1, wherein said control signal generating means comprises:

time-measuring means for producing a time-measuring signal; and send out means connected to said time-measuring means for receiving said time measuring signal in response to a judgment signal, and said judgment means which receives said time-measuring signal, outputs said judgment signal in accordance with said time measuring signal.

7. An automatic performance tempo control device according to claim 6, wherein said time measuring means comprises:

count means for outputting a count value; and operating means receiving said count value for operating said count value and a predetermined fixed value and for outputting a time measuring signal.

8. An automatic performance tempo control device according to claim 4 or claim 6, wherein said send out means produces said tempo control signal corresponding to said time-measuring signal.

* * * * *